United States Patent [19]

Hoffman

[11] 4,141,558

[45] Feb. 27, 1979

[54] GOLF BALL STORING, DISPENSING AND TEEING APPARATUS

[76] Inventor: James K. Hoffman, 8841 Independence Ave., Canoga Park, Calif. 91304

[21] Appl. No.: 873,362

[22] Filed: Jan. 30, 1978

[51] Int. Cl.[2] ..... A63B 57/00

[52] U.S. Cl. ..... 273/201; 221/301; 124/50

[58] Field of Search ..... 273/201, 33, 207, 209; 124/45, 49, 50; 221/289, 292, 293, 298, 299, 301; 193/21, 29; 198/359, 541, 542; 209/123, 124

[56] References Cited

U.S. PATENT DOCUMENTS

| | | | |
|---|---|---|---|
| 1,958,956 | 5/1934 | Preston | 221/301 |
| 2,071,356 | 2/1937 | Pagett | 273/201 |
| 2,171,299 | 8/1939 | Bectett | 273/201 |
| 2,285,342 | 6/1942 | MacLellan | 273/201 |
| 3,003,770 | 10/1961 | Jones | 273/201 |
| 3,756,606 | 9/1973 | Land | 273/201 |

*Primary Examiner*—William H. Grieb
*Assistant Examiner*—T. Brown
*Attorney, Agent, or Firm*—Fulwider, Patton, Rieber, Lee & Utecht

[57] ABSTRACT

A plurality of golf balls are stored in a canister from which they are received by a vertical supply tube that supports the canister. From the tube, the balls move into a delivery arm that carries a release mechanism on its outer end. Actuation of the release mechanism when the arm is in its delivery position causes a ball to be dispensed onto a tee. The arm, which is supported by a sleeve surrounding the supply tube, can then be rotated about a vertical axis until it extends rearwardly and out of the way in a rest position. The supply tube is provided with openings with which the arm can be aligned on either side so that the apparatus can be operated in a right- or left- handed mode.

21 Claims, 5 Drawing Figures

LEFT HANDED DELIVERY POSITION
REST POSITION
RIGHT HANDED DELIVERY POSITION

GOLF BALL STORING, DISPENSING AND TEEING APPARATUS

BACKGROUND OF THE INVENTION

The present invention relates to the sport of golf, and, more particularly, to an an apparatus for storing golf balls and positioning them on a tee.

Many golfers desire to improve their skills by driving numerous balls in succession from a single tee and commercial driving ranges as well as private practice areas have been constructed to accommodate them. These facilities are often in great demand, creating a need to decrease the time taken to hit a quantity of balls.

It has been found that a person driving golf balls spends a large portion of his time picking up and teeing the balls. Moreover, the necessity to repeatedly bend over and tee the next ball is fatiguing, rendering the activity less pleasant and more tiring for the participant. One solution to these problems is the use of a device that stores a quantity of balls and dispenses a single ball onto a tee when actuated by the user. Exemplary devices of this type are described in U.S. Pat. Nos. 3,127,177 to Benkoe and 3,599,983 to Melton.

The various teeing devices that have been proposed exhibit a number of disadvantages. Many are unduly complex, unreliable and expensive. Some do not consistently position the ball stably on the tee, thereby defeating their principal purpose. Other devices may intrude too much upon the golfer's field of vision and are, therefore, distracting. Another principal disadvantage of many teeing devices is that they are inherently suitable only for a right-handed golfer or for a left-handed golfer but are not readily adaptable for the use of either.

An objective of the present invention is to provide an improved teeing apparatus that overcomes the above disadvantages.

SUMMARY OF THE INVENTION

The present invention is embodied in a golf ball storing and dispensing apparatus employing a delivery arm that is rotatable about a vertical axis. The arm can be swung to a position at which its outer end is directly over a tee, and a releasing mechanism carried by the arm then dispenses a single ball. Then the arm can be moved rearwardly out of the way so that it does not interfere with the golfer's swing and does not intrude upon his field of vision.

In a particularly advantageous arrangement, the apparatus includes a canister for storing balls to be dispensed and a supply tube on which the canister is supported. The tube communicates with the interior of the canister to receive stored golf balls therefrom and supply them to the delivery arm.

In a preferred embodiment, the supply tube is vertically oriented and surrounded by a rotatable sleeve that supports the delivery arm. A stop prevents further rotation of the delivery arm once it is aligned with an opening in the supply tube to receive an additional ball. Simultaneously the downturned outer end of the arm is aligned with the tee to position a ball when the releasing mechanism is actuated.

The apparatus can be made usable by either right-handed or left-handed golfers by providing two openings on opposite sides of the supply tube. The stop mechanism then permits 180° of rotation allowing the delivery arm to be aligned with either of these openings. A golfer selects the appropriate side of the device on which to stand so that the delivery arm can swing rearwardly away from him, out of his field of vision. It is desirable to provide a rotatable collar on the downturned end of the arm which has a cut away portion to permit the arm to move away from the tee leaving the ball behind. The collar is turned to position the cut away on the proper side of the arm in view of the direction in which the arm is to be rotated.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figures 1, 2, 3, 4, 5:
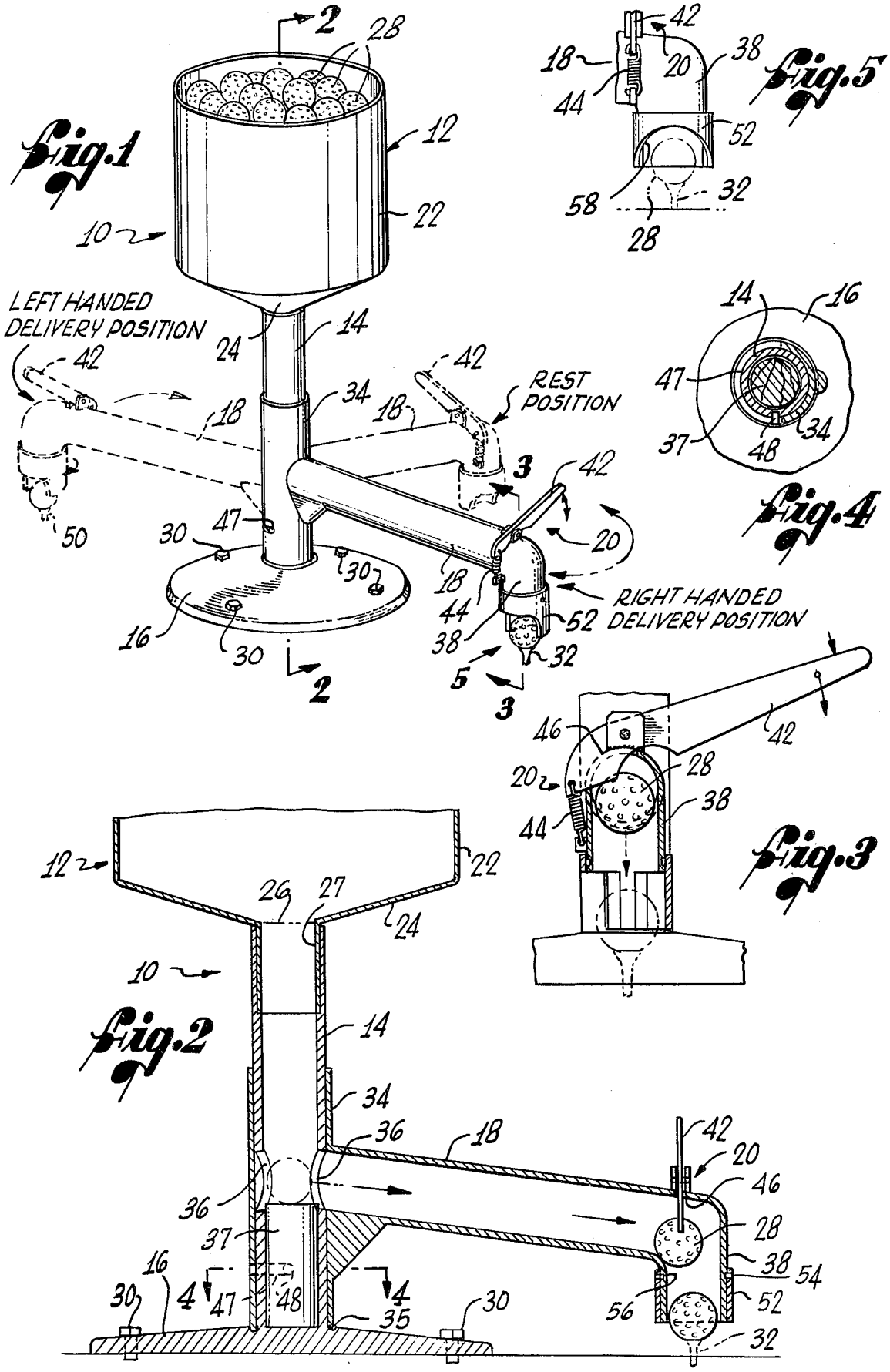
FIG. 1 is a pictorial representation of a golf ball storing and dispensing apparatus constructed in accordance with the present invention, the apparatus being shown in its right-hand dispensing position and, in phantom lines, in its rest position and its left-hand dispensing position.
FIG. 2 is an enlarged cross-sectional side view of the apparatus taken substantially along the line 2—2 of FIG. 1.
FIG. 3 is an enlarged cross-sectional view taken substantially along the line 3—3 of FIG. 1 and showing the releasing mechanism of the invention.
FIG. 4 is a cross-sectional view taken along the line 4—4 of FIG. 2.
FIG. 5 is an enlarged fragmentary side view of the dispensing end of the delivery arm taken in the direction of the arrow 5 of FIG. 1.

A golf ball dispensing and teeing apparatus 10 embodying novel features of the present invention is shown in FIGS. 1–5 of the accompanying drawings. In general, it includes a storage canister 12, a supply tube 14 supporting the canister, a base 16 on which the supply tube is mounted, a delivery arm 18 connected to the supply tube, and a ball releasing mechanism 20 carried by the arm.

The canister 12 is generally cylindrical having vertical side walls 22 and a conical bottom surface 24 that extends downwardly to a centrally disposed circular opening 26. A tubular mounting 27 projects downwardly from the opening 26. The canister 12 is large enough to store a plurality of golf balls 28 all of which are guided, under the force of gravity toward the opening 26, but only one ball at a time can enter the opening.

The supply tube 14 is vertically oriented and receives the mounting 27 internally in its top end. It defines a vertical, cylindrical, internal passageway of sufficient diameter to receive a single column of golf balls from the opening 26 at the bottom of the canister 12.

Integrally formed with the tube 14 is the base 16 on which the tube 14 is mounted at its lower end, the base being generally horizontal and disk-like. It is secured by four bolts 30 to a deck or platform (not shown) on which a golfer stands to drive the balls 28.

To convey the balls 28 from the supply tube 14 to a tee 32 positioned adjacent to the base 16, the delivery arm 18 extends outwardly from the tube and is inclined slightly downwardly forming a small angle with the horizontal so that its outer end is lower than its inner end. A rotatable cylindrical sleeve 34 that supports the arm 18 surrounds the lower end of the tube 14 and rides in an annular groove 35 in the top surface of the base 16. The arm 18 is thus rotatable with the sleeve 34 about a vertical axis coincident with the longitudinal axis of the tube 14.

The arm 18 is tubular and defines a cylindrical internal passageway of sufficient diameter to accommodate a single row of balls 28. A pair of openings 36 are oppositely disposed on the sides of the tube 14 at the same height as the inner end of the arm 18, these openings being large enough to allow one ball 28 at a time to pass through. To prevent the balls 28 from moving downwardly past the openings 36, a blocking member 37 inserted in the bottom end of the tube 14 has its top surface aligned with the bottoms of the openings 36. At the outer end of the arm 18 is a short downturned portion 38 that can be positioned directly over the tee 32 by rotating the arm 14 to the proper orientation.

The releasing mechanism 20 (shown in FIGS. 1–3) is adjacent to the downturned portion 38. It includes a lever 42 pivotably mounted atop the arm 14 and biased by a coil spring 44 toward a position in which it projects through a slot 46 in the arm to prevent the lead ball 28 from entering the downturned portion 38. When the lever 42 is pivoted out of the slot 46, tensioning the spring 44, a ball 28 rolls into the downturned portion 38 and drops from the open end of the arm 14 onto the tee 32 below.

It is noted that the ball 28 moves only a very small distance to the tee 32 once released by the lever 42, thus closely controlling the movement of the ball and almost eliminating the time lag between the actuation of the releasing mechanism 20 and the delivery.

To aid in positioning the end of the arm 18 accurately above the tee 32, the device 10 includes a stop mechanism formed by a horizontal slot 47 in the tube 14, near its lower end, and a lug 48 that projects from the blocking member 37 into the slot (as best shown in FIGS. 2 and 4). The length and position of the slot 47 are such that the arm 18 can rotate through an arc of about 180°. With the lug 48 at one extreme end of the slot 47, the outer end of the arm 18 is located directly over the tee 32 and cannot move farther in the direction in which the ball 28 is to be driven. The arm 18 can, however, rotate counterclockwise and rearwardly from that delivery position (shown in solid lines in FIG. 1) to an out of the way rest position (shown in phantom lines in FIG. 1) 90° removed from the delivery position. In the event that the device 10 is to be used by a left-handed golfer, the arm 18 can rotate farther in a counterclockwise direction until it is aligned with a second tee 50, at which point the lug 48 reaches the other end of the slot 47 to stop the arm in its properly aligned position. This simple arrangement permits the device 10 to be used by either a right-handed or a left-handed golfer without modification. At the same time, it stops the arm 42 in proper alignment with either tee 32, 50. The rest position remains the same regardless of whether it is used in the right or left-hand mode, the arm 42 extending to the rear where it does not intrude unduly upon the golfer's field of vision.

To further facilitate the use of the device 10 in both modes, a rotatable collar 52 extends downwardly from the downturned outer end 38 of the arm 18. The collar includes an interlocking portion 54 received by a groove 56 on the downturned end 38, although many different arrangements for rotatably mounting the collar could be employed. Although the collar 52 extends downwardly past the center of the ball 28 when the ball is positioned on one of the tees 32, 50, it has a cutaway portion 58 (best shown in FIG. 5) on one side that permits it to move away from the ball, returning to the rest position and leaving the ball behind on the tee. The likelihood of a ball 28 falling off the tee 32, 50 is minimized by the collar 52 which prevents ball movement away from the tee in all directions but one.

To operate the device 10, a golfer first places a quantity of balls 28 in the canister 12, allowing the balls to fill the supply tube 14 and the delivery arm 18. He then swings the arm 18 as far as it will go in a clockwise direction so that the outer end of the arm is aligned with the tee 32 (assuming he is right-handed). He briefly depresses the top end of the lever 42 to release a ball 28 onto the tee 32 and then swings the arm 18 counterclockwise to its rest position. When he is ready for the next ball 28, the process is repeated. Movement of the arm 18 and actuation of the release mechanism 20 can be effected using the head of a golf club so that it is not necessary to bend over.

It will be noted that when the collar 52 has its cutaway portion 58 properly positioned for use in the right-hand mode (tee 32) it is on the wrong side of the arm 18 for use in the left-hand mode (tee 50). This difficulty is readily overcome, however, by rotating the collar 52 to properly orient the cutaway portion 58 for the desired mode of operation.

It will be appreciated that the invention provides a golf dispensing mechanism that is easily and inexpensively manufactured. All components except the spring 44 can be plastic so that it can be exposed to the weather and can be cleaned by simply hosing it down. Since a minimum of moving parts are used, the action of the device is positive and it is not readily susceptible to malfunction. There is little chance of a ball 28 being improperly positioned since it is released at a point very near the tee 32, 50 and its movement after release is closely confined by the arm 18 and collar 52. The time taken for the ball 28 to be positioned after the releasing mechanism 20 is actuated is minimized to eliminate unnecessary delay. Moreover, an apparatus constructed in accordance with the invention is usable by both right and left handed golfers.

While particular forms of the invention have been illustrated and described, it will also be apparent that various modifications can be made without departing from the spirit and scope of the invention.

I claim:

1. A dispensing and teeing apparatus for golf balls comprising:

a canister for storing a plurality of golf balls to be dispensed;

a supply member for said golf balls extending downwardly from said canister and in communication with the interior thereof to receive said stored golf balls therefrom;

a delivery member connected to said supply member; and releasing means carried by said delivery member to release said golf balls sequentially therefrom onto a tee;

said delivery member being pivotable about a vertical axis to move away from said tee after one of said golf balls has been released.

2. The apparatus of claim 1 wherein said supply member is vertically oriented and tubular.

3. The apparatus of claim 1 wherein said delivery member is inclined downwardly toward said tee.

4. The apparatus of claim 3 wherein said delivery member is tubular, of sufficient internal diameter to permit a single row of golf balls to pass therethrough and has a downturned outer end adjacent to said releasing means.

5. The apparatus of claim 4 wherein said releasing means comprises a pivotably mounted lever and a spring biasing said lever toward a position in which it interferes with the movement of golf balls along said delivery member.

6. The apparatus of claim 1 wherein said supply member is vertically oriented and tubular and said delivery member is inclined slightly downwardly from the horizontal and away from said supply member toward said tee.

7. The apparatus of claim 6 further comprising a rotatable sleeve surrounding said supply member, said delivery member being secured to said sleeve for rotation therewith.

8. The apparatus of claim 7 further comprising an opening in said supply member so positioned that said delivery member can be aligned with said opening to receive said golf balls.

9. The apparatus of claim 8 further comprising a second opening in said supply member disposed opposite said first mentioned opening to permit use of said apparatus by a right or left-handed golfer.

10. The apparatus of claim 8 further comprising a blocking member disposed within said supply member and aligned with said opening to limit movement of said golf balls within said supply member.

11. The apparatus of claim 1 further comprising stop means for preventing movement of said delivery member beyond said tee.

12. The apparatus of claim 11 wherein said stop means permits approximately 180° of rotation of said delivery member.

13. The apparatus of claim 1 wherein said canister has a conical bottom surface with an opening at the center thereof, said supply member being a vertical tube aligned with said opening and supporting said canister, said apparatus further comprising a horizontal base on which said supply member is mounted.

14. The apparatus of claim 13 further comprising a rotatable sleeve surrounding said supply member, said delivery member being tubular, attached to said sleeve and inclined downwardly from said collar toward said tee.

15. The apparatus of claim 14 further comprising an opening in said supply member so positioned that said delivery member can be aligned with said opening to receive said golf balls therefrom.

16. The apparatus of claim 14 further comprising a second opening in said supply member disposed opposite said first mentioned opening to permit use of said apparatus by a right-handed or left-handed golfer.

17. The apparatus of claim 14 further comprising stop means for preventing movement of said delivery member beyond said tee.

18. The apparatus of claim 1 further comprising a collar rotatably mounted on said delivery member for guiding said golf balls toward said tee, said collar having a cut away portion to permit said delivery member to move away from said golf ball once said golf ball is supported by said tee.

19. A dispensing and teeing apparatus for golf balls comprising:

a canister for storing a plurality of golf balls to be dispensed;

a tubular vertical supply member for said golf balls supporting said canister and extending downwardly from said canister and in communication with the interior thereof to receive golf balls therefrom, said supply member having two oppositely disposed openings therein to permit golf balls to pass outwardly therefrom;

a horizontal base on which said supply member is mounted;

a tubular delivery arm extending downwardly from said supply member toward a tee, forming a small angle with the horizontal and having a downturned outer end, said delivery arm being rotatable about a vertical axis for alignment with either of said openings;

releasing means carried by said delivery arm for releasing said golf balls sequentially therefrom onto said tee; and stop means for limiting movement of said delivery arm to facilitate alignment of said delivery arm with said openings and with said tee.

20. The apparatus of claim 19 further comprising a collar rotatably mounted on said delivery arm for guiding said golf balls toward said tee, said collar having a cut away portion to permit said delivery member to move away from said golf ball once said golf ball is supported by said tee.

21. A dispensing and teeing apparatus for golf balls usable by a right-handed or left-handed golfer, said apparatus comprising:

a cylindrical canister having a conical bottom surface for storing a plurality of golf balls to be dispensed;

a vertical tubular supply member supporting said canister and extending downwardly from the center of said canister and in communication with the interior of said canister through said bottom surface thereof to receive golf balls therefrom, said supply member having two oppositely disposed openings to permit golf balls to pass outwardly therefrom;

a blocking member disposed within said supply member in alignment with said openings;

a disk-like horizontal base on which said canister is mounted;

a rotatable sleeve surrounding said supply member;

a tubular delivery arm supported by said sleeve, extending downwardly therefrom at a slight incline and having a downturned outer end portion, said delivery arm being movable as said sleeve is rotated for alignment with either of said openings;

releasing means for releasing said golf balls sequentially from said delivery arm, said releasing means including a lever pivotably mounted on said delivery arm adjacent said end portion;

a collar rotatably mounted on said end portion of said delivery member for guiding said golf balls, said collar having a cutaway portion to permit said delivery arm to move away from said golf ball once said golf ball is supported by a tee; and stop means for limiting rotation of said sleeve and said delivery arm to position said delivery arm in alignment with either of said openings and said tee.

* * * * *